US007246562B2

(12) United States Patent
Lee et al.

(10) Patent No.: US 7,246,562 B2
(45) Date of Patent: Jul. 24, 2007

(54) STRUCTURE OF DELIVERY DOOR HAVING ANTI-THEFT SECURITY MEANS

(76) Inventors: Jin-Kook Lee, 1092-26, Gohjae 2-dong, Yeonjae-gu, Pusan 611-072 (KR); Sung-Hae Lee, 1092-26, Gohjae 2-dong, Yeonjae-gu, Pusan 611-072 (KR)

( * ) Notice: Subject to any disclaimer, the term of this patent is extended or adjusted under 35 U.S.C. 154(b) by 397 days.

(21) Appl. No.: 10/449,041

(22) Filed: May 29, 2003

(65) Prior Publication Data

US 2004/0216650 A1 Nov. 4, 2004

Related U.S. Application Data

(63) Continuation of application No. PCT/KR00/01403, filed on Dec. 1, 2000.

(51) Int. Cl.
*E05B 7/32* (2006.01)

(52) U.S. Cl. ..... 109/73; 109/19; 109/48; 232/1 E; 232/43.3; 220/478; 108/167

(58) Field of Classification Search ..... 109/11–13, 109/17–19, 45–49, 55–57, 73; 232/19, 44, 232/1 E; 220/476; 49/68; 312/258; 108/166–167, 108/171, 60

See application file for complete search history.

(56) References Cited

U.S. PATENT DOCUMENTS 1,455,569 A * 5/1923 Caminoni, Jr. ..... 312/238
2,027,491 A * 1/1936 Percy ..... 312/242
2,163,356 A * 6/1939 Solberg ..... 49/67
3,955,322 A * 5/1976 Call, Jr. ..... 49/40
4,336,973 A * 6/1982 Bae ..... 312/199
4,351,247 A 9/1982 Clark
4,466,357 A 8/1984 Masachika
4,489,662 A 12/1984 Masachika
4,573,416 A 3/1986 Masachika
4,909,052 A 3/1990 Hutwohl

FOREIGN PATENT DOCUMENTS

JP 7139270 5/1995

* cited by examiner

*Primary Examiner*—Suzanne Dino Barrett
*Assistant Examiner*—Christopher Boswell
(74) *Attorney, Agent, or Firm*—Tuchman & Park LLC

(57) ABSTRACT

The present invention relates to a delivery door having anti-theft security means, more particularly to a door structure consists of a pair of casings, area adjustable mounting plate, hinge means and actuation means, which are installed on an entrance door or a window for delivering articles or products thereof. A delivery door installed on an entrance door or a window comprise an outer casing (4) and an inner casing (5) pivotally mounted on hinge means (3, 8, 9, 10), actuation means (12, 13, 15, 16) associated with the outer casing (4) and the inner casing (5) for opening and closing operation of casings and the mounting plate (6) having area adjustable means between the outer casing (4) and the inner casing (5) is characterized in that the mounting plate (6) is rotatable while in the transporting operation which securely controlled by the actuation means.

18 Claims, 13 Drawing Sheets

STRUCTURE OF DELIVERY DOOR HAVING ANTI-THEFT SECURITY MEANS

CROSS-REFERENCES TO RELATED APPLICATIONS

This application is a continuation of pending International Patent Application No. PCT/KR00/01403 filed Dec. 1, 2000, which designates the United States.

BACKGROUND OF THE INVENTION

1. Field of the Invention

This present invention relates to a structure of delivery door having anti-theft security means more particularly to a door structure comprised of a pair of casings, a mounting plate, hinge means and actuation means cooperatively formed on a suitable location of entrance door or window for delivering or transporting articles or products thereof.

2. Description of the Related Art

Recently, there has been tremendous growth in the delivery business of small packages in accordance with the rapid increase of ordering amount via Internet-based retail, TV-home shopping or any other communication means. In order to receive the ordered parcels or gifts in safe way, a delivery door having the safe means attached on an entrance door is necessary for the safe final delivery whether the resident is at home or not. Although the resident is at home, a safe door for the delivery purpose is required in order to receive the delivered gift or articles without opening the entrance door because the resident usually want to protect himself without exposure from the unknown person. Furthermore, the deliveries of products are frequently attempted at the times when the residents are not at home. Depending on the business policies of delivery service, the delivery must then be attempted on a subsequent day or the package may be simply left on the recipient's door step. Each of these alternatives has disadvantages for the recipient and often make a trouble for the delivery service. In the case of the vacancy of resident, the delivered parcels or articles are also required to convey into the entrance door in order to prevent the lost of delivered product or the reattempt of delivery.

According to the prior art of structure related to a safe door in the connection with the delivery means, various structures can be found depending on the kind of product or the size of delivering product.

U.S. Pat. No. 4,909,052 shows a simple structure of delivery door having a shape of secure box or a safe housing attached on the entrance door for the delivery means. But this kind of structure is limited to pick-up article or relatively small size of mail package. Furthermore, the deposited product in the secure box is less safe under the action of theft and the shape of secure box is less compatible with the flat surface of the entrance door.

For the another security purpose, Masachika had devised a series of the security devices of delivery door for the after hour depository having a relatively complicate but the secure structure published on U.S. Pat. Nos. 4,573,416, 4,489,662 and 4,466,357. These kinds of structures are usually applicable in wall of bank or place required a special purpose of depository, for example the after hour depository of video tapes. The relatively larger volume of delivered product based on the conventional package is hard to apply the above-mentioned structure to an entrance door.

Therefore, the main embodiment of present invention is related to provide a delivery door having a simply structure of security means which is compatible to the flat shape of entrance door and to deliver products through the entrance door whether the resident is at home or not.

SUMMARY OF THE INVENTION

This invention has been accomplished in a view of above-mentioned background and is intended to provide a simple structure of delivery door having a secure delivery means which can widely be applicable to an entrance door or a window depending on the purpose of delivery or transport.

Accordingly, the present invention provides a secure delivery tool for receiving articles or small packages whether the resident is at home or not. Especially, in the case of the resident is not at home, the present invention is proposed to devise a workable device as an automatic delivery door in cooperated with a monitoring system which installed in front of the entrance door.

In addition, the application of embodiment under the present invention is related to provide a mounting structure of flowering pot applicable to install on window frame for transporting a flowering pot from outdoor to indoor or adversely without handing the mounted flowering pot on the mounting plate.

BRIEF DESCRIPTION OF THE DRAWINGS

The foregoing and other objects, aspects, and advantages will be better understood from the following detailed description of preferred embodiments of the invention with reference to the drawings, in which.

DETAILED DESCRIPTION OF THE DRAWINGS

Hereinafter, the preferred embodiments of delivery door according to the present invention will be described in detail with the references of accompanying drawings.

Figure 10A:
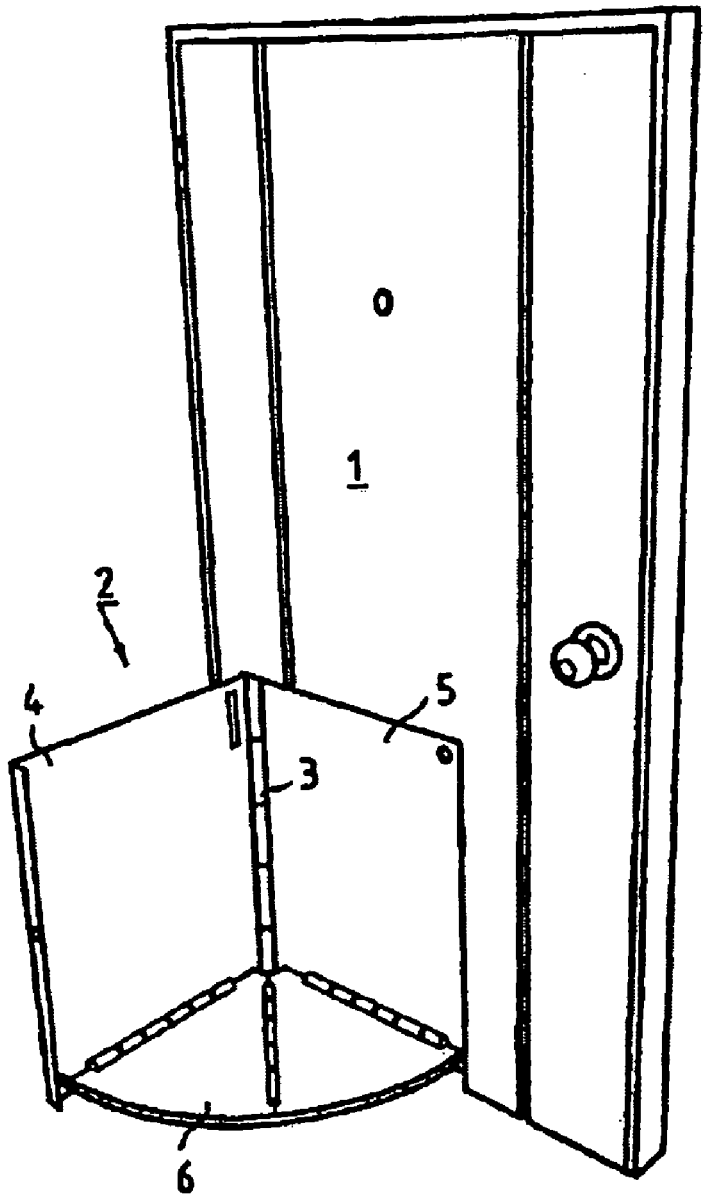
FIGS. 10*a*, 10*b*, 11 are related to illustrative views of the embodiment of present invention.

A delivery door according to the present invention is to install on a conventional entrance door 1 and to utilize the delivery door for delivering articles or transporting the delivered products more in a secure way without opening the entrance door 1. Conventionally, so as to deliver or dispatch relatively larger size of articles or products for the safety purpose, the present invention is desirable to install or to construct on the below part of the entrance door 1 as shown on FIG. 10*a* and FIG. 12. But the delivery door 2 under the present invention can be located at the appropriated position having the desirable size on the entrance door or window frame depending the usages.

The detail constitutions and embodiments related to the present invention will be described hereinbelow with the illustrative examples.

Figure 1:
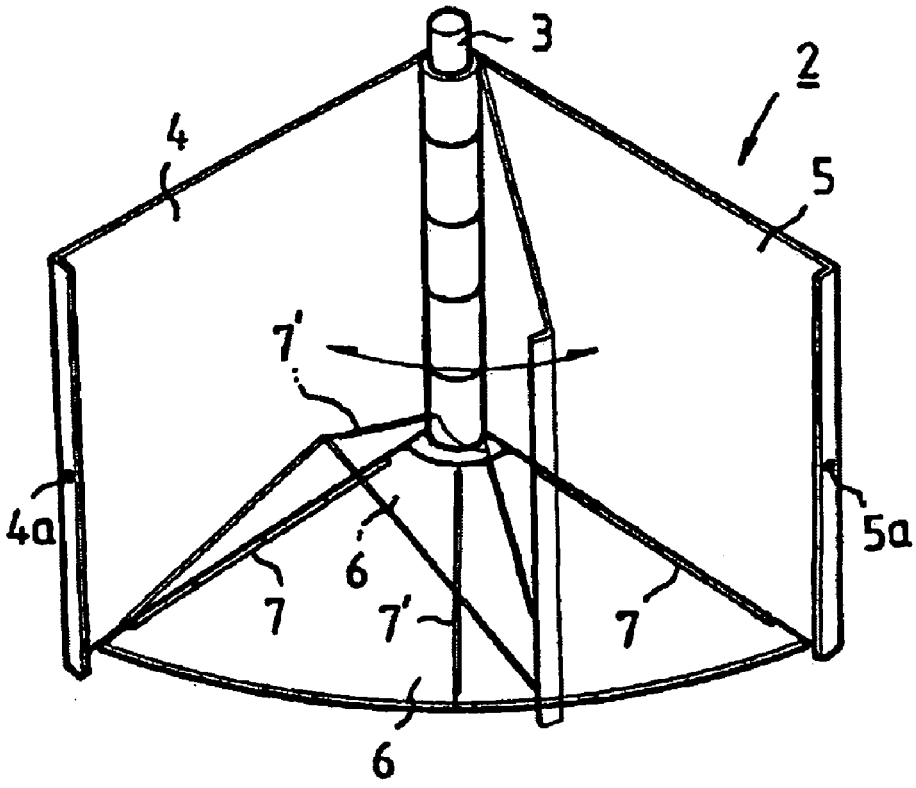
FIG. 1 is related to a perspective view of generic embodiment according to the present invention.

As shown on the FIG. 1, a delivery door of outer casing (4) and inner casing (5) are pivotally mounted on the hinge means (3), and are mutually linked each other by a mounting plate (6) associated with connecting pieces (7, 7') thereon. The outer casing (4) and inner casing (5) formed on the outer and inner delivery door, which are pivoting independently about the hinge means (3), are configured on the part of entrance door (1) or window (22).

Figure 10B:
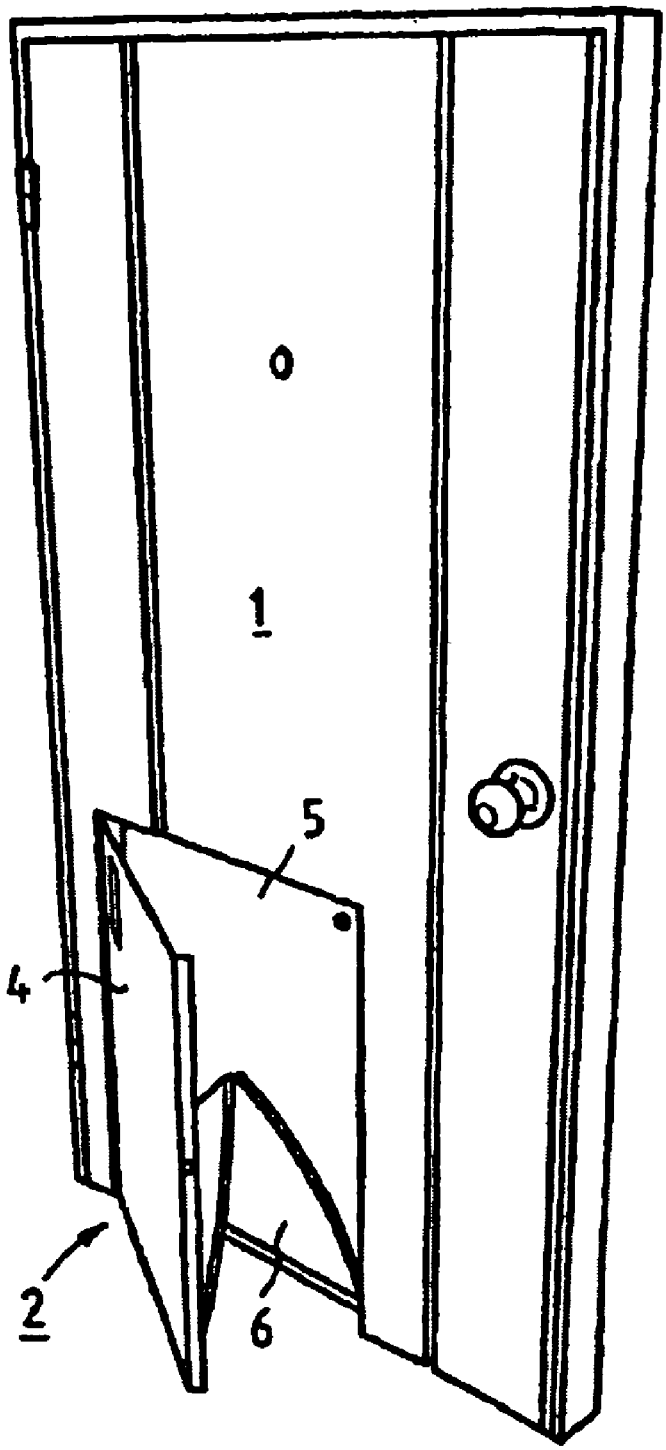
Figure 11:
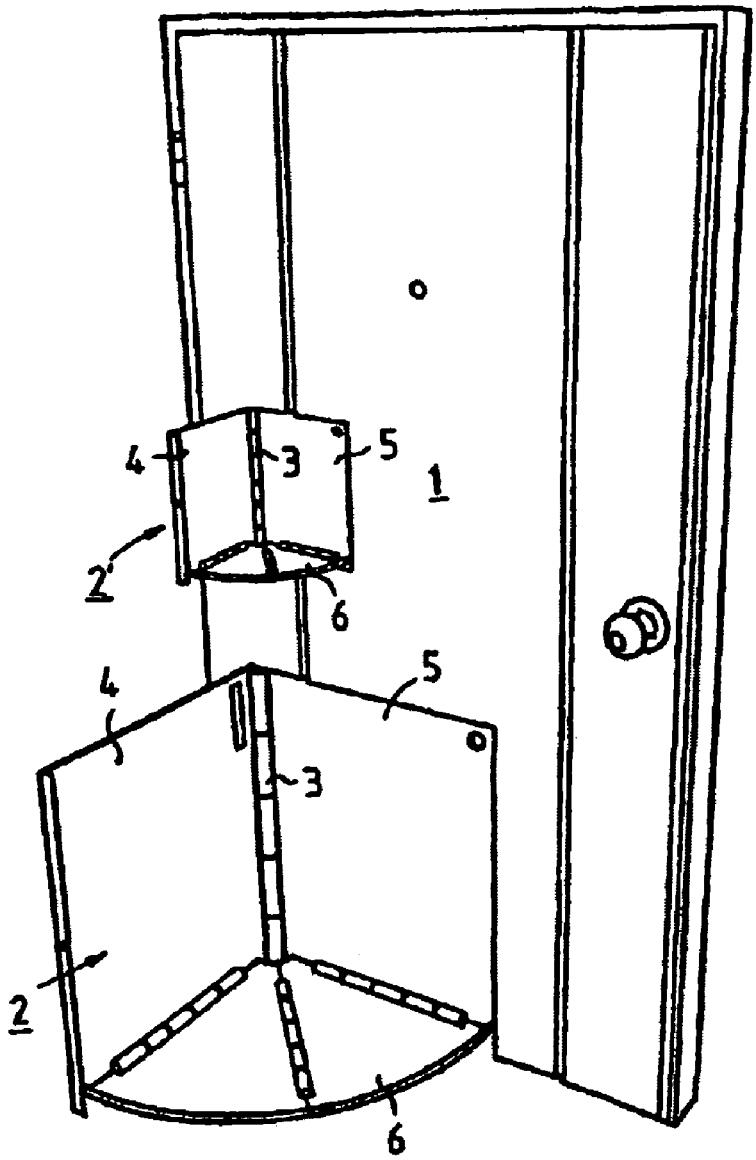

Between two pivoting casings (4) (5), a mounting plate (6) having the area adjustable means is provided. The mounting plate (6) alternatively can be comprised of foldable means or slidable means. As shown on the FIG. 10*b*, the foldable means of area adjustment related to the mounting plate (6) is constructed so as to fold in the upward direction while in the closing operation between the outer and inner casing in contrast to the downward direction for the unfolding of mounting plate (6) resulting the opening of the delivery door (2).

Although not shown on the figures, one can accomplish the embodiment of the area adjustment related to the mounting plate (6) using a linear combination of arc shaped slidable pieces resulting the area adjusting function of the mounting plate (6) while in the closing and opening of the delivery door. The mounting plate (6) cooperated with the pair of casings under the present invention play a vital role for the delivery means of articles maintaining the security purpose. The articles or delivered products put on the mounting plate (6) after opening the outer casing (4) moves into the inside of entrance door (1) by the pivotal motion of mounting plate resulting opening of the inner casing (5) into the inner side of the entrance door.

The pivotal motion of mounting plate (6) for the delivery operation into the inside of entrance door (1) can be accomplished by the manual operation at the location of the inside of entrance door by the host or the outside of door by the delivery man.

Simply the manual operation of delivery door by pulling the inner casing (5) into the inner direction by the host at the location of the inside entrance door makes the delivered products into the inside of entrance door (1). Also pushing operation of outer casing (5) by a delivery man after putting the articles on the mounting plate (6) completes the safe delivery process resulting the dosing operation of the outer casing (4) of the delivery door relative to the entrance door.

Figure 2:
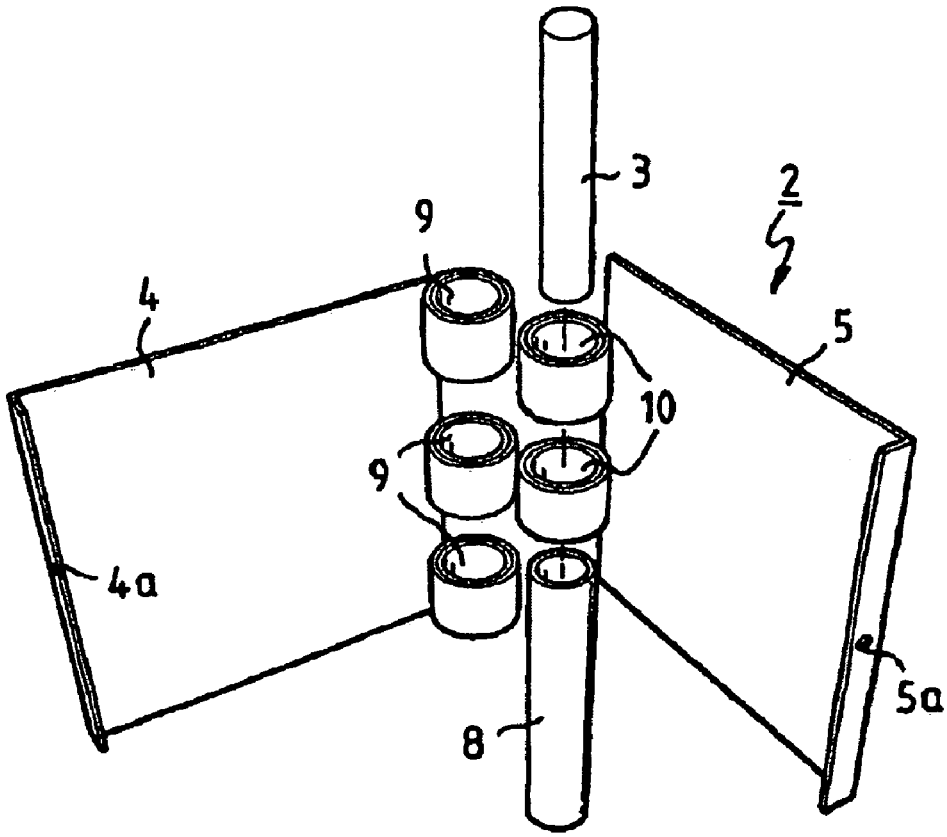
FIG. 2 is a separate perspective view of an embodiment of hinge means according to the present invention.
Figure 3:
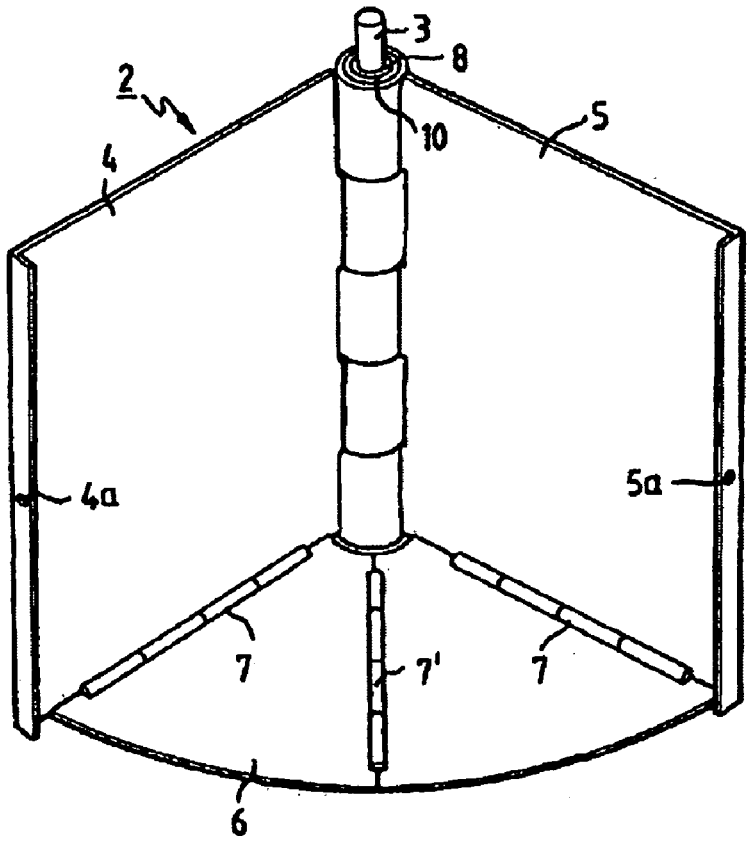
FIG. 3 shows a perspective view of a combined structure of FIG. 2.

The pivotal motion of mounting plate (6) in connection with the safe delivery process in addition to the above mentioned manual operation can be applied in an advance way with the mutual operation of unidirectional bearing installed on the hinge means (3) as shown on the FIGS. 2 and 3.

Although not shown on the figures, the manual operation as an actuation means to the present invention can be further comprised a conventional mechanical device which can transform the pushing or pulling force exerted by foot into the rotational force of the casings.

According to another embodiment of hinge means (3), an inner unidirectional bearing (8) which rotate only into the clockwise direction is axially installed on the hinge means (3).

In addition to the inner unidirectional bearing (8) to the hinge mean (3), the outer unidirectional bearings (9) (10) which rotate into anticlockwise direction in opposite to the unidirectional bearing (8) are insertably combined with the inner unidirectional and axially installed on the hinge means (3) in connection with the outer casing (4) and inner casing (5) respectively.

Figure 4:
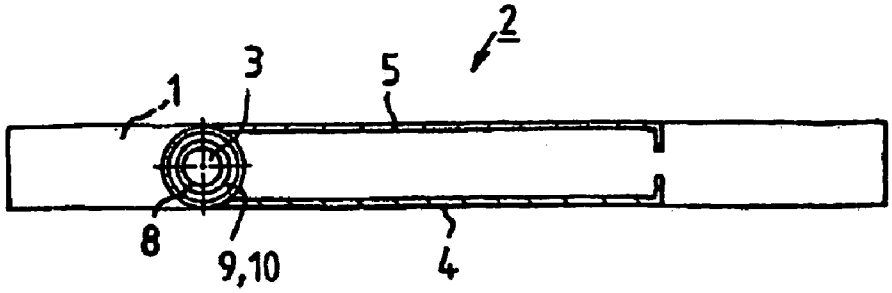
FIG. 4 is an upper cross sectional view of FIG. 3.
Figure 4A:
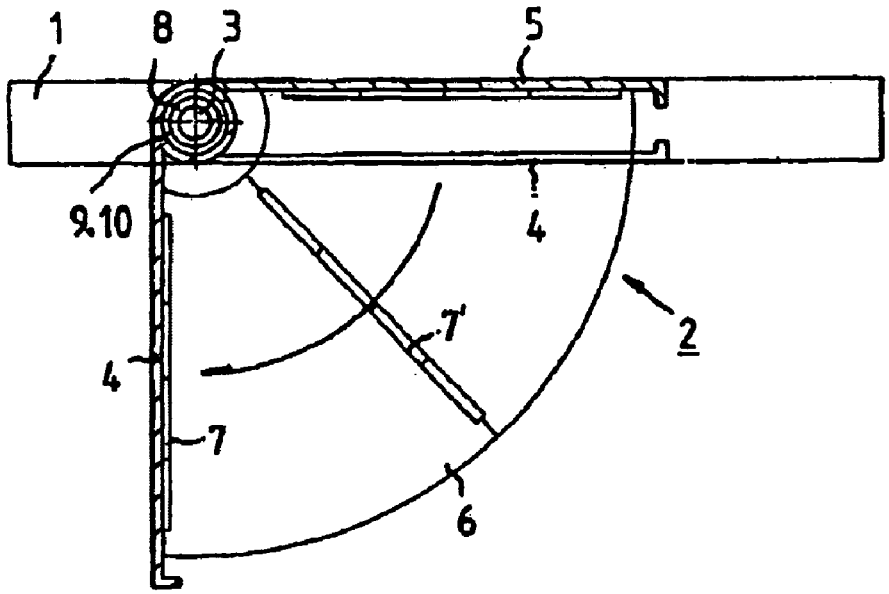
FIG. 4*a* to FIG. 4*c* are related to the schematic views of operational state of FIG. 2.
Figure 4B:
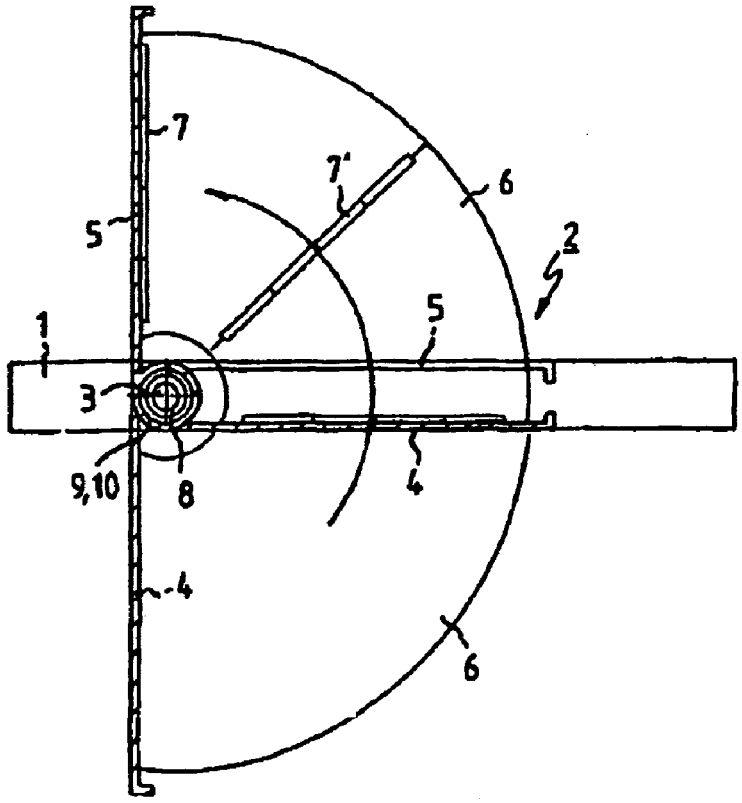
Figure 4C:
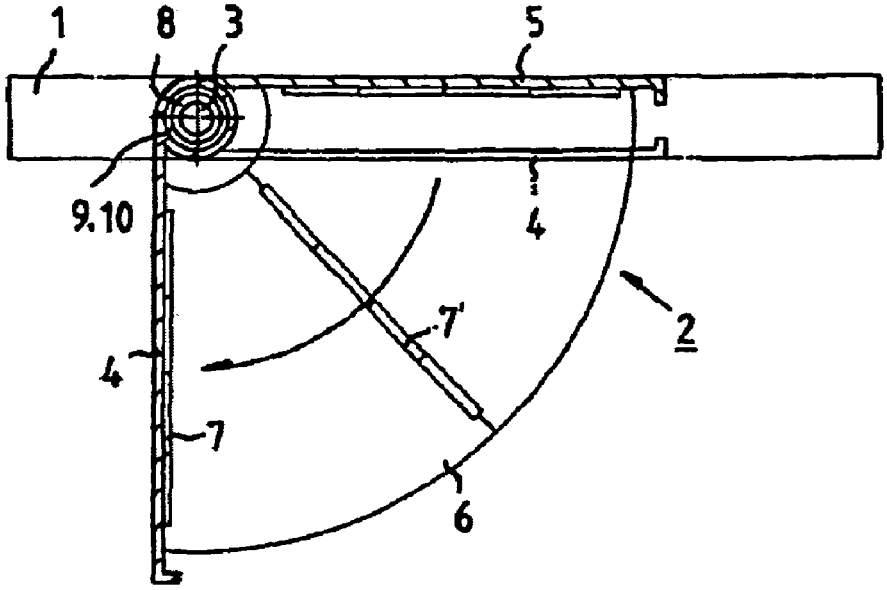

As also shown on the FIG. 4*a* to 4*c*, the pivotal motion of mounting plate (6) is accomplished with the embodiment of the unidirectional bearings.

Since the outer casing (4) is combined with the outer unidirectional bearing (9) only workable to the anticlockwise direction of entrance door, the opening operation of outer casing (4) into the outer direction of entrance door (1) is actuated by the operation of the inner unidirectional bearing (8) which is operatable with the clockwise rotation resulting the unfolding operation of mounting plate (6).

Similarly to the operational mechanism of FIG. 1, the pivotal motion of mounting plate (6) for the delivery operation into the inside of entrance door (1) can be accomplished by the manual or foot operation at the location of the inside of entrance door by the host or the outside of door by the delivery man.

The manual or foot operation of delivery door (2) by pulling the inner casing (5) into the inner direction by a host at the location of the inside entrance door makes the delivered product into the inside of entrance door (1) resulting the actuation of the outer unidirectional bearing (9) connected to the outer casing (4).

Also a pushing operation of outer casing (5) by a delivery man after putting the articles on the mounting plate (6) completes the safe delivery process resulting the closing operation of outer casing (4) of the delivery door relative to the entrance door resulting the actuation of outer unidirectional bearing (10) connected to inner casing (5).

The embodiment of area variation related to the mounting plate (6) in cooperation with the closing and opening operation of delivery door (2) can be applied to the embodiment of the unidirectional bearing in the same way as described with the FIG. 1.

Without changing the generic embodiment of present invention, the present structure can be also widely applied with the constitutions related to the mechanical apparatus which can be an actuation means.

Figure 5:
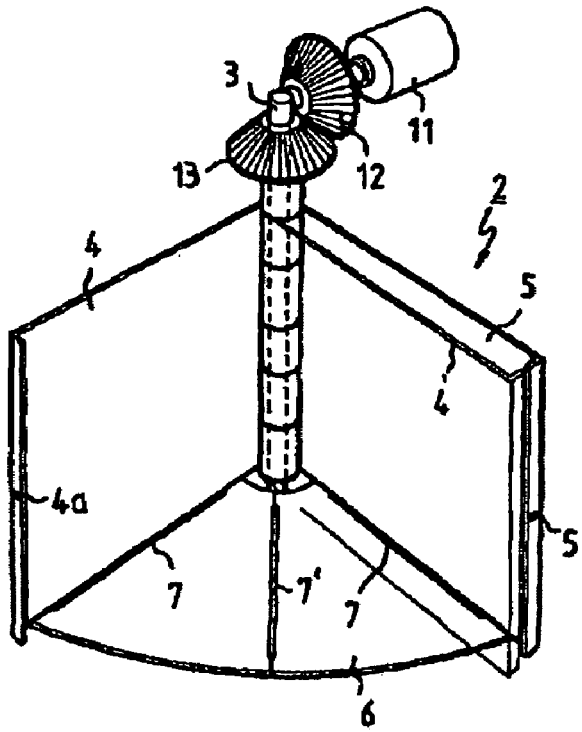
FIG. 5 is a perspective view of an embodiment of actuation means using bevel gears under the present invention.
Figure 7:
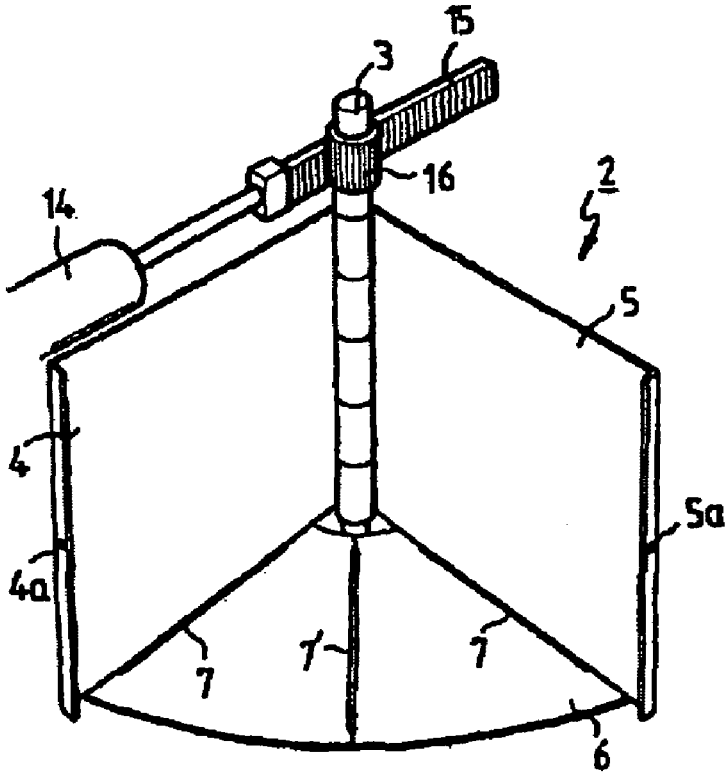
FIG. 7 is a perspective view of another embodiment of actuation means using rack and pinion gear under the present invention.

FIG. 5 and FIG. 7 are related to the embodiments of electric driving apparatus for opening and closing the delivery door (2). The detail configuration and mechanism for the operation with the mechanical apparatus will be described hereinbelow.

As shown on the FIG. 5, the outer casing (4) is fixedly installed on the hinge means (3) and an axial bevel gear (13) installed on the axis of hinge means (3) is operated by the tooth wheel gearing with the driving bevel gear (12) which is driven by the electric motor (11). But the inner casing (5) is freely installed on the hinge means (3) so that it can be rotated by the rotational torque of the mounting plate (6) or the manual operation.

Figure 6A:
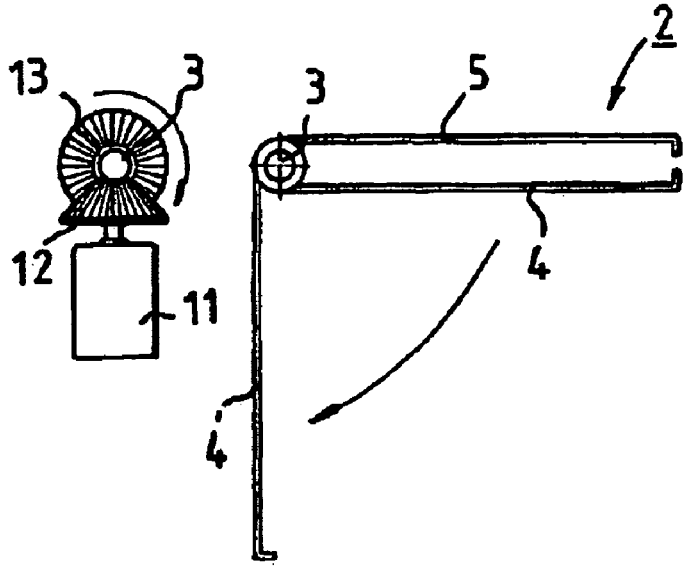
FIG. 6*a* to FIG. 6*c* are related to the schematic views of operational state of FIG. 5.
Figure 6B:
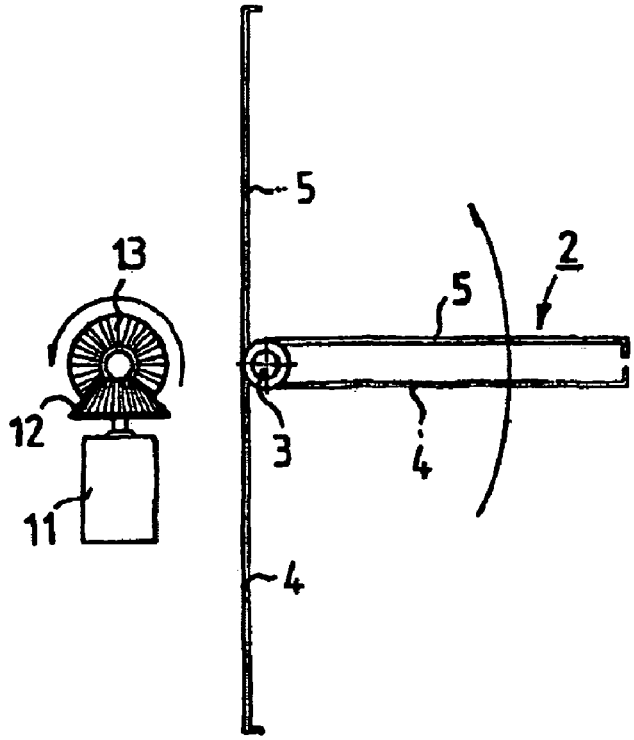
Figure 6C:
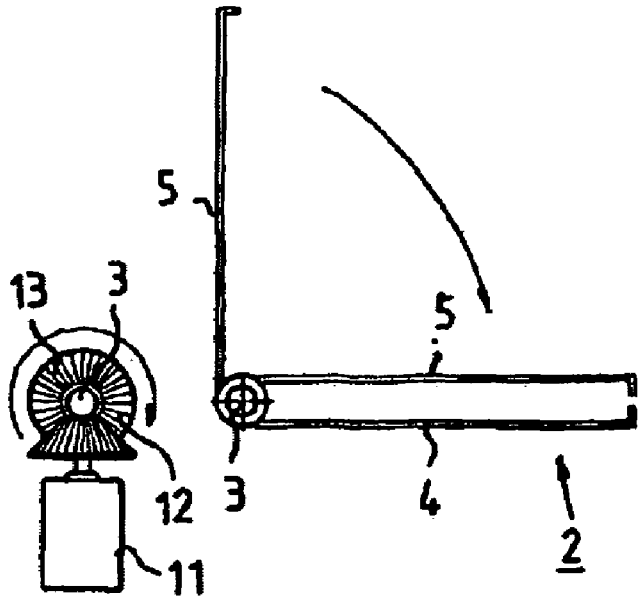

As illustrated on the FIGS. 6*a* to 6*c*, the rotational motion of driving bevel gear (12) driven by the electric motor (11) actuates the opening operation of the outer casing (4) for the delivery. The rotational tooth wheel gearing between the driving gear (12) and axial bevel gear (13) provides the sequential rotation of the outer casing (4) which is fixed installed on the hinge means (3) resulting the unfolding operation of mounting plate (6). For the closing operation of outer casing (4), it is reversely related to the rotational motion of bevel gears (13), (14) comparing with the opening operation of the casing (4). Since the inner casing (15) is freely installed on the hinge means (3), the pivotal motion of mounting plate (6) exerted by the reverse rotation of cogwheels provide the rotational motion of inner casing (5) resulting the opening of inner casing (5) into the inner side of the entrance door.

Accordingly, the articles or delivered products on the mounting plate (6) are delivered into the inner side of the entrance door by the mechanical apparatus in the more convenient way. At the end, the closing operation for the inner casing (5) is done by the manual operation resulting the folding operation of mounting plate (6) in the same way.

FIG. 7 shows another embodiment related to the mechanical apparatus of rack (15) and pinion gear (16). The outer casing (4) is fixedly installed on the hinge means (3) and an axial pinion gear (16) installed on the axis of hinge means (3) is operated by the tooth wheel gearing with the rack gear (15) which is driven by the driven cylinder (14). But the inner casing (5) is freely installed on the hinge means (3) so that it can be rotated by the rotational torque of the mounting plate (6) or the manual operation.

Figure 8A:
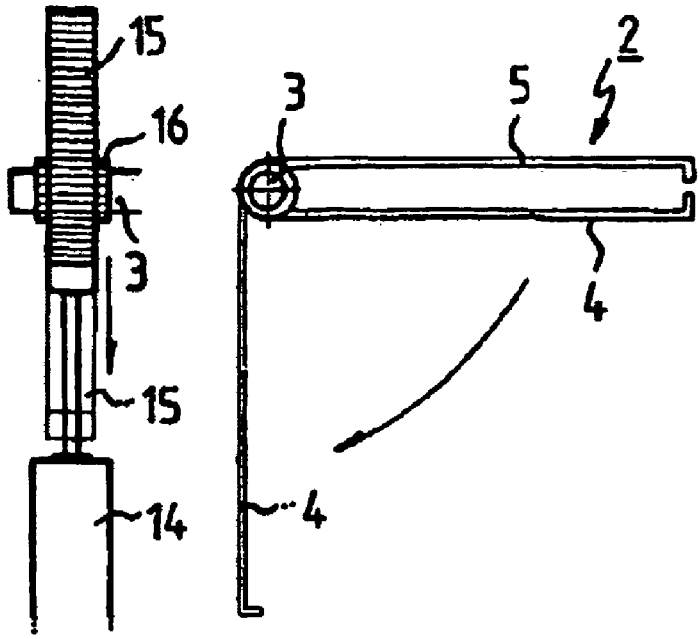
FIG. 8*a* to FIG. 8*c* are related to the schematic views of operational state of FIG. 7.
Figure 8B:
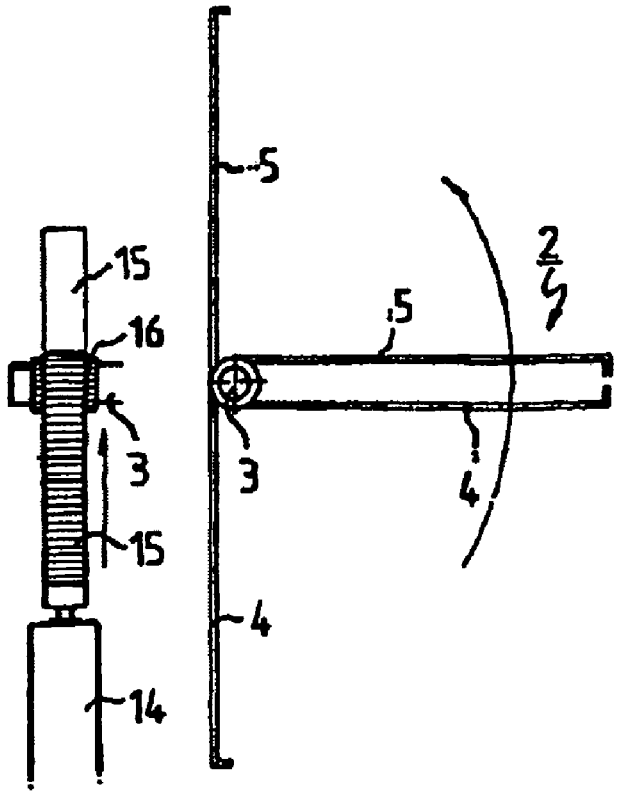
Figure 8C:
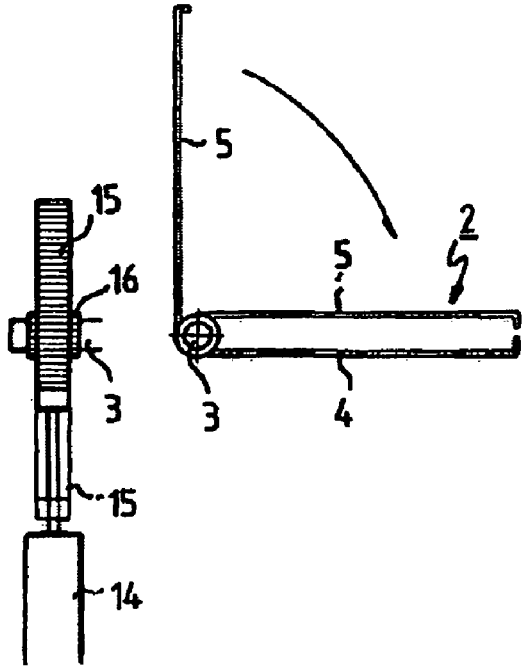

As illustrated on FIG. 8*a* to 8*c*, the linear motion of rack gear (15) driven by the driven cylinder (14) actuates the opening operation of the outer casing (4) for the delivery. The linear tooth wheel gearing between the rack gear (15) and pinion gear (16) provides the sequential rotation of the outer casing (4) which is fixed installed on the hinge means (3) resulting the unfolding operation of mounting plate (6). For the closing operation of outer casing (4), it is reversely related to the rotational motion of pinion gear (16) comparing with the opening operation of the casing (4). Since the inner casing (15) is freely installed on the hinge means (3), the pivotal motion of mounting plate (6) exerted by the reverse rotation of cogwheels provide the rotational motion of inner casing (5) resulting the opening of inner casing (5) into the inner side of the entrance door.

Accordingly, the articles or delivered products on the mounting plate (6) are delivered into the inner side of the entrance door by the mechanical apparatus in the more convenient way. Finally, the closing operation for the inner casing (5) is done by the manual or foot operation resulting the folding operation of mounting plate (6) as described on the above-mentioned illustrations.

In cooperation with the monitoring system installed in front of the delivery door, a conventional electrical circuit of switching operation for driving the tooth wheel gearing apparatus is enable to deliver even though the vacancy of person in the house.

Figure 9:
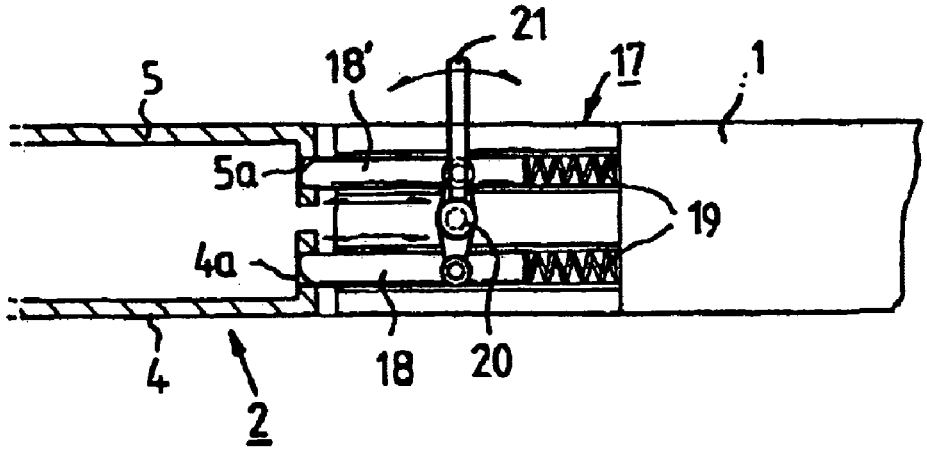
FIG. 9 is related to a sectional view of locking means under the present invention.

In addition to the constitution, a locker 17 of locking means for the outer casing (4) and the inner casing (5) can be formed for the safety reason. As shown on the FIG. 9, a locker (17) is comprised of the biased the locking pin (17, 17') by the resilient force caused by the coil spring (19) for locking onto the locking holes (17, 18'). At the center of the locking pin (18, 18'), the operating lever (21) related to the bilateral arc motion actuates the locking or unlocking operation in the alternative way or in the simultaneous way. Besides the above-mentioned locking means, various conventional locking techniques can be applied depending on the requirements.

Figure 12:
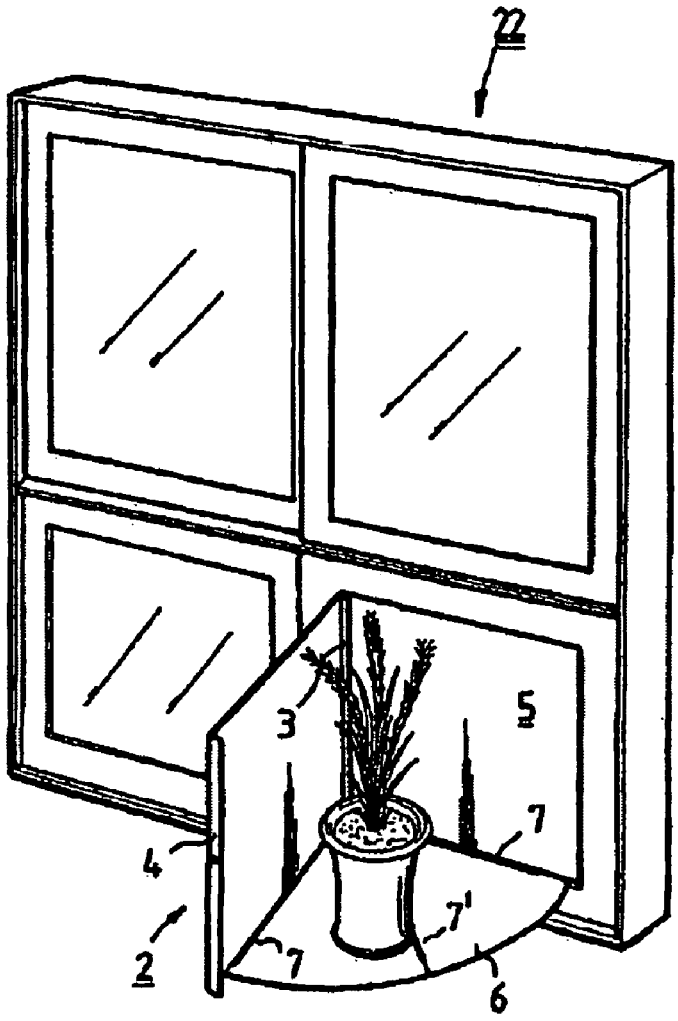
FIG. 12 shows a typical embodiment of present invention related to window frame.

Another useful application of the generic embodiment of present invention is related to the applicable installation to the part of window as shown on FIG. 12.

The mounting plate (6) co-operated with a pair of casings (4) (5) under the present invention plays a role for the delivery means of flowering pot maintaining the security purpose of this invention.

Of course, the outer casing (4) and inner casing (5) can be made of the window materials having the transparent property. For the cultivation purpose of flowering pot, the present invention is very useful in that the mounting plate (6) can be utilized the delivery means for transporting the flowering pot from the outside window to the inside place according to the requirements.

The flowering pot on the mounting plate (6) between the outer casing (4) and the inner casing (5) can be exposed conveniently to the sunlight or the raining environment and returns to the inside position for the purpose of the interior decoration without disturbing the window's function of guard shield.

INDUSTRIAL APPLICABILITY

The industrial utilization of delivery door under the present invention is greatly promoted in order to meet the requirements of tremendous growth in the delivery business of small packages in accordance with the rapid increase of ordering amount via Internet-based retail, TV-home shopping or any other communication means.

As shown on the typical utilization of transporting a flowering pot, the application of present structure is applicable to a window frame besides the entrance door. Especially, in the case of the resident is not at home, the present invention is also a useful devise to set an automatic delivery door in cooperated with a monitoring system which installed in front of the entrance door.

While the invention has been described in terms of a few preferred embodiments, those skilled in the art will recognize that the invention can be practiced with modification within the spirit and scope of the appended claims.

What is claimed is:

1. A delivery door for delivering articles comprising:

an outer casing and an inner casing pivotally mounted to a vertical hinge member; and a mounting plate formed of two plates foldably connected to each other, said mounting plate having a first end portion coupled with said outer casing and a second end portion coupled with said inner casing, said mounting plate defining a closed position with the two plates folded and an open position with the two plates unfolded, the open position for receiving an article for delivery on said mounting plate, said mounting plate being rotatable about said hinge member along with said inner and outer casings, while having the two plates in the open position and a delivery article on the two plates, such that the delivery article is delivered to an inner side of a building through the delivery door;

wherein the delivery door is applied to an entrance door of the building for transporting articles or flowering pots after placing the articles on the mounting plate between the inner casing and the outer casing.

2. A delivery door defined in claim 1, wherein said mounting plate is rotatable together with said inner casing and said outer casing by manual or foot operation.

3. A delivery door defined in claim 1, further comprising an actuation means associated with said outer casing and inner casing for operating the outer casing and inner casing.

4. A delivery door defined in claim 3, wherein said actuation means is characterized by tooth wheel gearing between a rack gear and a pinion gear.

5. A delivery door defined in claim 3, wherein said actuation means is characterized by tooth wheel gearing between a driving bevel gear and an axial bevel gear.

6. A delivery door defined in claim 1, further comprising locking means having a locking pin for operating between a locking position to lock at least one of said outer and inner casings and an unlocking position to unlock at least one of said outer and inner casings.

7. A delivery door defined in claim 6, wherein said locking means comprises a first locking pin for locking and unlocking said outer casing and a second locking pin, and an operating lever is coupled to said first and second locking pins for selectively operating said locking pins.

8. A delivery door defined in claim 7, wherein said first and second locking pins are biased by a spring to the locking position.

9. A delivery door defined in claim 1, wherein said hinge member comprises an inner unidirectional bearing coupled to the hinge axis of said hinge member, and outer unidirectional bearings coupled to said outer and inner casings and to the hinge axis of said hinge member for rotating in a direction opposite to said inner unidirectional bearing.

10. A delivery door for delivering articles comprising:

an outer casing and an inner casing pivotally mounted to a vertical hinge member; and a mounting plate formed of two plates foldably connected to each other, said mounting plate having a first end portion coupled with said outer casing and a second end portion coupled with said inner casing, said mounting plate defining a closed position with the two plates folded and an open position with the two plates unfolded, the open position for receiving an article for delivery on said mounting plate, said mounting plate being rotatable about said hinge member along with said inner and outer casings, while having the two plates in the open position and a delivery article on the two plates, such that the delivery article is delivered to an inner side of a building through the delivery door;

wherein the delivery door is applied to a window frame of the building for transporting articles or flowering pots after placing the articles on the mounting plate between the inner casing and the outer casing.

11. A delivery door defined in claim 10, wherein said mounting plate is rotatable together with said inner casing and said outer casing by manual or foot operation.

12. A delivery door defined in claim 10, further comprising an actuation means associated with said outer casing and inner casing for operating the outer casing and inner casing.

13. A delivery door defined in claim 12, wherein said actuation means is characterized by tooth wheel gearing between a rack gear and a pinion gear.

14. A delivery door defined in claim 12, wherein said actuation means is characterized by tooth wheel gearing between a driving bevel gear and an axial bevel gear.

15. A delivery door defined in claim 10, further comprising locking means having a locking pin for operating between a locking position to lock at least one of said outer and inner casings and an unlocking position to unlock at least one of said outer and inner casings.

16. A delivery door defined in claim 15, wherein said locking means comprises a first locking pin for locking and unlocking said outer casing and a second locking pin, and an operating lever is coupled to said first and second locking pins for selectively operating said locking pins.

17. A delivery door defined in claim 16, wherein said first and second locking pins are biased by a spring to the locking position.

18. A delivery door defined in claim 10, wherein said hinge member comprises an inner unidirectional bearing coupled to the hinge axis of said hinge member, and outer unidirectional bearings coupled to said outer and inner casings and to the hinge axis of said hinge member for rotating in a direction opposite to said inner unidirectional bearing.

* * * * *